US006467927B1

(12) United States Patent
Haugaard et al.

(10) Patent No.: US 6,467,927 B1
(45) Date of Patent: Oct. 22, 2002

(54) OVERHEAD INDUSTRIAL LIGHT FIXTURE WITH MOUNTED REFLECTOR

(75) Inventors: Eric Haugaard, Kenosha, WI (US); Kurt Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 0 days.

(21) Appl. No.: 09/696,543

(22) Filed: Oct. 24, 2000

(51) Int. Cl.[7] ..... F21K 2/00

(52) U.S. Cl. ..... 362/147; 362/265; 362/221; 362/404; 362/519

(58) Field of Search ..... 362/265, 221, 362/396, 404, 408, 519, 147; 248/906; 174/50

(56) References Cited

U.S. PATENT DOCUMENTS 4,219,869 A * 8/1980 Bowman et al. ..... 362/147
4,403,277 A * 9/1983 Eargle, Jr. et al. ..... 362/263
5,820,252 A * 10/1998 Finch ..... 362/265
RE36,414 E * 11/1999 Tickner ..... 362/235
6,390,655 B1 * 5/2002 Haugaard et al. ..... 362/396

* cited by examiner

*Primary Examiner*—Sandra O'Shea
*Assistant Examiner*—Anabel Ton
(74) *Attorney, Agent, or Firm*—Jansson, Shupe & Munger, Ltd.

(57) ABSTRACT

An overhead industrial light fixture of the type including a housing, power-related components and a lamp-mounting socket. The housing has top and bottom walls and sidewalls together forming a substantially enclosed space, and the bottom wall defines a socket location. The bottom wall includes a plurality of downward projections around the socket location, and a reflector is secured to the housing by attachment at the downward projections, creating an air flow gap for cooling purposes between the reflector and the housing. In some preferred embodiments, the bottom wall defines a socket window, and the socket is in the enclosed space with its lamp-receiving end aligned with the socket window. In some preferred embodiments, the bottom wall is formed of sheet metal and the projections are stampings therein.

12 Claims, 9 Drawing Sheets

OVERHEAD INDUSTRIAL LIGHT FIXTURE WITH MOUNTED REFLECTOR

FIELD OF THE INVENTION

This invention is related generally to overhead industrial light fixtures.

BACKGROUND OF THE INVENTION

A wide variety of overhead industrial light fixtures exist to serve needs such as factory and warehouse illumination and the like, and a number of advances have been made over the years. However, existing overhead industrial light fixtures have a number of problems and shortcomings, and it is to addressing such problems and shortcomings that this invention is directed.

Of particular concern is that many overhead industrial light fixtures of the prior art are unwieldy in size and shape, which makes them expensive to manufacture, expensive to ship and store, difficult to install and service, in some cases unattractive in appearance and even unacceptable or difficult to use in certain size-restricted applications. In some cases an effort to make a more compact overhead industrial light fixture can tend to cause problems of overheating of critical components. While this might be addressed by use of baffles and other insulating features, such approaches increase manufacturing costs and comprises ease of installation and service.

One possible approach to deal with certain of the above problems and shortcomings is use of a housing with one or more external power-related components, such as the ballast. However, this approach complicates installation, increases cost and makes achieving a pleasing appearance difficult at best.

In the prior art, a variety of overhead industrial light fixtures are made using expensive die cast housings, and in some cases, complex housings are used to achieve various ends. In some cases, various external parts are required in order to support the electrical components; such structures once again, do not lend themselves to a pleasing appearance in an overhead industrial light fixture.

This invention relates to one feature which is helpful in addressing certain of the aforementioned problems and shortcomings.

OBJECTS OF THE INVENTION

It is an object of this invention to provide an improved overhead industrial light fixture overcoming some of the problems and shortcomings of the prior art.

Another object of this invention is to provide an overhead industrial light fixture which facilitates venting of hot air from around the lamp and minimizing entry of heat into the light fixture housing.

Another object is to provide an improved overhead industrial light fixture that simplifies structures related to reflector mounting.

Another object is to provide an improved overhead industrial light fixture that simplifies manufacture.

Another object is to provide an improved overhead industrial light fixture that is inexpensive to manufacture and easy to install.

Another object is to provide an improved overhead industrial light fixture that does not require an expensive die cast housing.

Still another object of the invention is to provide an improved overhead industrial light fixture which is compact and yet free of problems of overheating critical components.

These and other objects of the invention will be apparent from the following descriptions and from the drawings.

SUMMARY OF THE INVENTION

This invention is an improvement in overhead industrial light fixtures of the type including a housing, power-related components (e.g., a ballast, a capacitor and an igniter), a lamp-mounting socket, and usually a reflector.

In the improvement of this invention, the housing, which has top and bottom walls and sidewalls therebetween to form a substantially enclosed space, has a bottom wall which defines a socket location. The housing bottom includes a plurality of downward projections around the socket window, and a reflector is secured to the housing by attachment thereto at the downward projections. Such projections allow the reflector to be mounted directly onto the housing in a manner providing an annular air gap therebetween. This allows heat from the lamp to escape from the space within the reflector by convection through the annular gap.

In preferred embodiments, at least the bottom wall is formed of sheet metal and the projections are stampings therein 'i.e., metal deformations made using normal metal-working press operations or the like.

In highly preferred embodiments, the housing bottom wall defines a socket window at the socket location, and the downward projections are around the socket window, and the socket is secured with respect to the housing in a position substantially within the enclosed space with its lamp-receiving end substantially aligned, both horizontally and vertically, with the socket window. This allows the overhead light fixture to have a low profile.

In highly preferred embodiments, the housing has two enclosure-forming members consisting essentially of (1) a top member which forms the top wall and downwardly-extending sidewall portions; and (2) a bottom member which is shaped for fitted engagement with the top member and forms the bottom wall and upwardly-extending sidewall portions. The upwardly-extending sidewall portions of the bottom member and the downwardly-extending sidewall portions of the top member together complete the sidewalls of the housing.

In such preferred embodiments, it is most preferred that the downwardly-extending sidewall portions of the top member include two opposed endwalls, each extending downwardly from the top wall and terminating in an end flange which engages and is fastened to the bottom member. The end flanges of the endwalls are most preferably engaged with and fastened to the bottom wall.

In certain preferred embodiments of this invention, the top member includes (a) a central top-wall portion having opposite edges and (b) a pair of lateral top-wall portions below and on opposite sides of the central top-wall portion, each having an inner and an outer edge, and the downwardly-extending sidewall portions of the top member include a pair of opposed upper sidewall portions each extending downwardly from one of the opposite edges of the central top-wall portion to the inner edge of one of the lateral top-wall portions. Most preferably, each of the lateral top-wall portions has a side flange at its outer edge, and such side flange and outer edge (of each lateral top-wall portion), at their common juncture, engage one of the upwardly-extending sidewall portions of the bottom member, to help provide the fitted engagement of the bottom member of the housing with the top member of the housing.

In certain preferred embodiments of this invention, the top and bottom members, with their aforementioned top or bottom surfaces, their side surfaces, and their flanges, are each formed of sheet metal which is bent to form the junctures referred to above. The projections from the bottom wall, as indicated above, are preferably stampings therein.

As used herein, the following terms have the meanings given below, unless the context requires otherwise:

In referring to an overhead industrial light fixture, the term "overhead" refers to fixtures which are typically mounted, directly or indirectly, on ceilings or overhead structural members of some sort, such as in factories, warehouses, etc. (regardless of purpose), or any other overhead structure put in place for the purpose of supporting a light fixture. The term "industrial" is used in order to differentiate from residential lighting or the like. Neither of these terms is to be taken as limiting.

The term "power-related components" includes ballasts, capacitors, igniters and other devices for creating the proper electrical power usable for a selected lamp, such as high-intensity discharge (HID) lamps of various kinds.

The term "substantially enclosed," as used with respect to a space within a housing, means surrounded, but does not mean closed from the inflow and outflow of air. Indeed, as can be seen in the drawings, certain of the walls of the housing are heavily vented to allow essentially unrestricted inflow and outflow of air, for purposes of cooling. This invention involves enclosure of power-related components and recessing of the socket into the housing, and for these reasons cooling by convection flow is of great importance.

As used with respect to the socket, the term "substantially within" does not rule out protrusion of a small portion of the lamp-receiving end of the socket from the housing, through the socket window.

The term "low-profile" as applied to a lighting fixture means that the fixture is lower in profile than occurs when the socket is not recessed into the housing.

The terms "top" and "bottom" used herein with reference to the fixture, or parts thereof, assume the normal use orientation of the fixture.

The overhead industrial light fixture of this invention, in its various forms, overcomes certain problems and shortcomings of the prior art, including those referred to above.

BRIEF DESCRIPTION OF THE DRAWINGS

The drawings illustrate preferred embodiments which include the above-noted characteristics and features of the invention. The invention will be readily understood from the descriptions and from the drawings, in which.

DETAILED DESCRIPTION OF PREFERRED EMBODIMENTS

Figure 1:
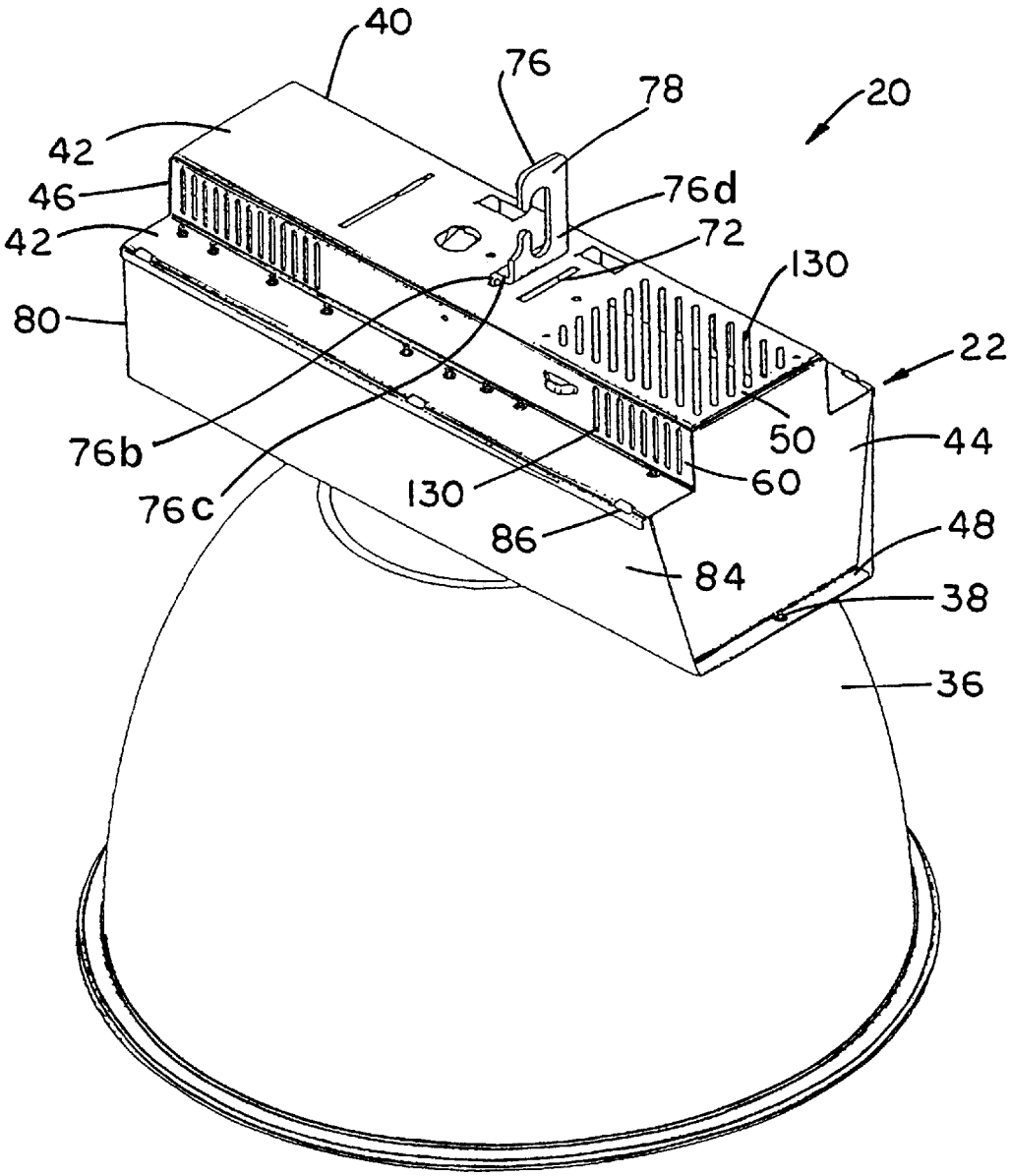
FIG. 1 is a perspective view of a preferred industrial light fixture in accordance with this invention.

The drawings illustrate an overhead industrial light fixture 20 which includes: a housing 22; power-related components including a ballast 24, a capacitor 26, and an igniter 30; a capacitor mounting strap 28; a socket mount 32; a lamp-mounting socket 34; and a reflector 36. Such elements are best seen in FIGS. 2 and 12.

Figure 2:
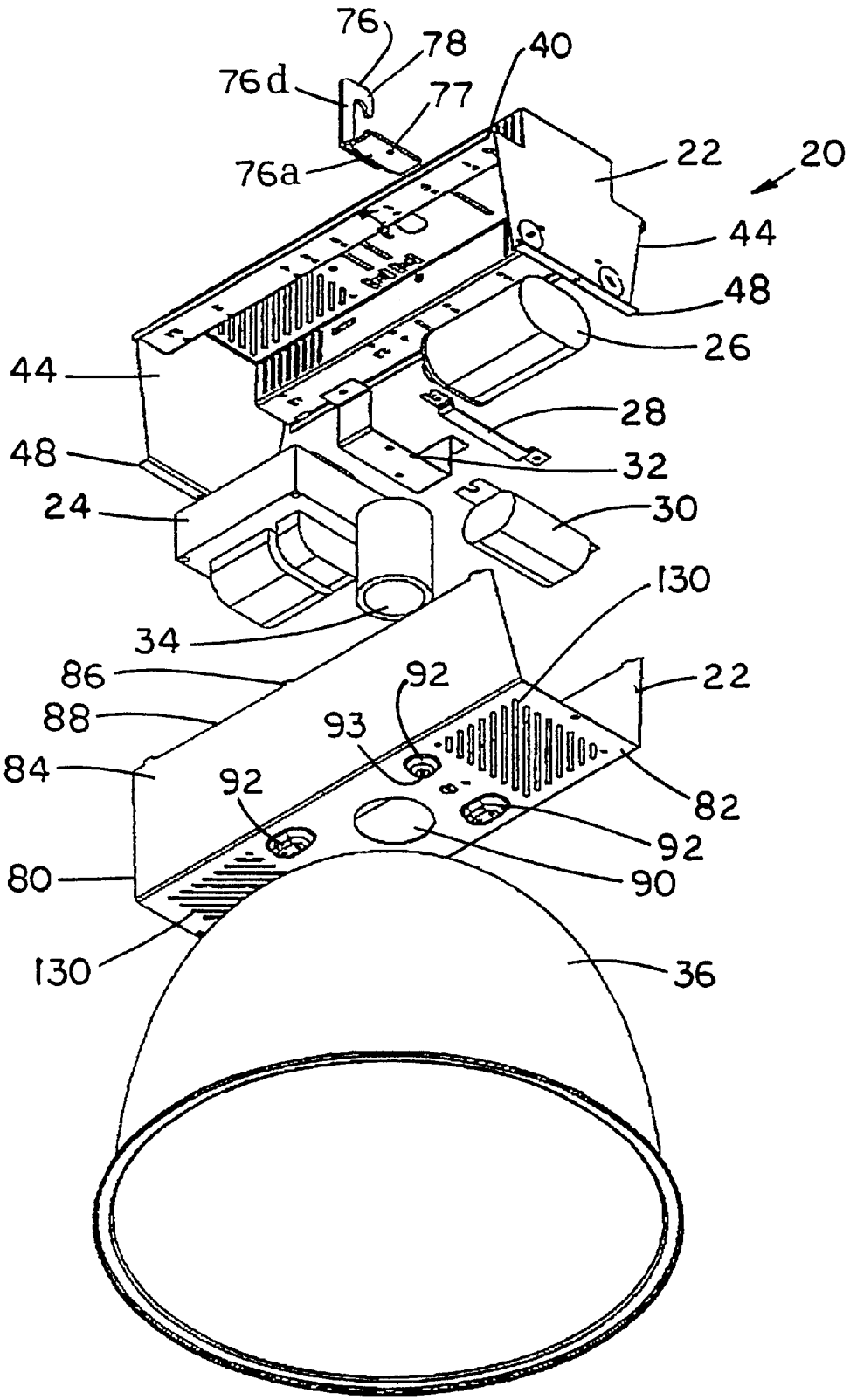
FIG. 2 is an exploded perspective view of the device of FIG. 1.
Figure 12:
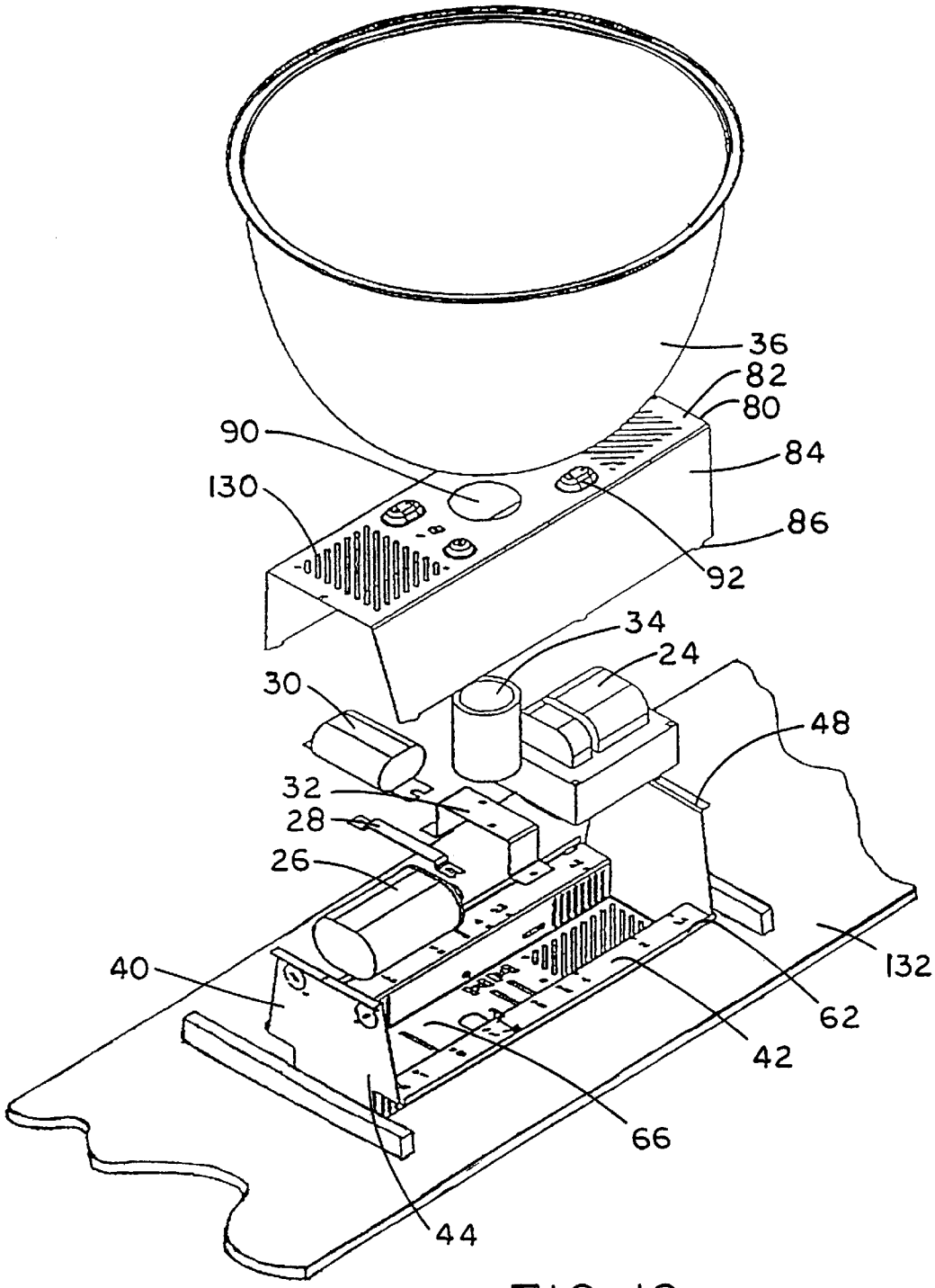
FIG. 12 is an exploded perspective view of the assembly of a device in accordance with this invention illustrating the method of manufacture.

Referring to FIGS. 1–2 and 12, housing 22 has enclosure-forming top and bottom members 40 and 80, respectively. Top member 40 forms a top wall 42, two opposed downwardly-extending endwalls 44 and two opposed downwardly-extending sidewall portions 46. Bottom member 80 is in fitted engagement with top member 40 and forms a bottom wall 82 and two opposed upwardly-extending sidewalls 84 which, together with the downwardly-extending sidewall portions 46, and endwalls 44 of top member 40, define a substantially enclosed space within housing 22. Bottom member 80 includes tabs 86 at the terminal edge 88 of sidewalls 84. Bottom wall 82 of bottom member 80 further defines a socket window 90.

Figure 3:
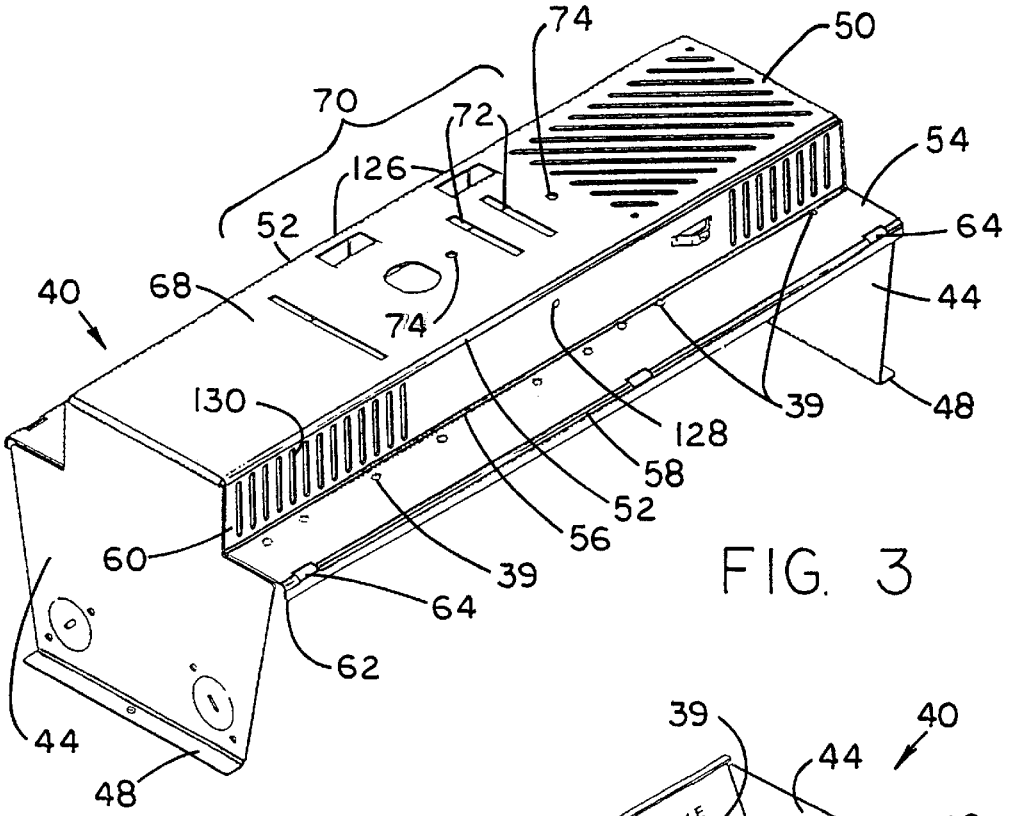
FIG. 3 is a top perspective view of the top member of the housing of the device of FIG. 1.
Figure 4:
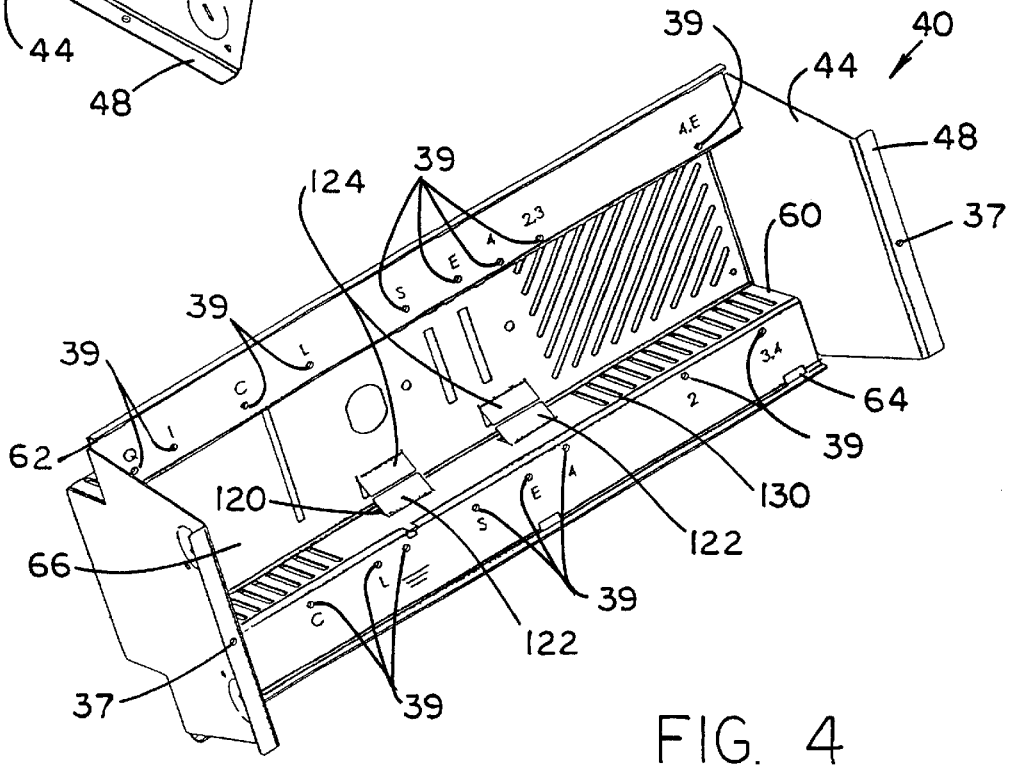
FIG. 4 is a bottom perspective view of the top member of the housing of the device of FIG. 1.

As seen in FIGS. 3 and 4, endwalls 44 of top member 40 terminate in end flanges 48 fastened to bottom wall 82 of bottom member 80 by fasteners 38. Top member 40 includes a central top-wall portion 50 having opposite edges 52 and a pair of lateral top-wall portions 54 below and on opposite sides of central top-wall portion 50. Lateral top-wall portions 54 each have an inner edge 56 and an outer edge 58. Downwardly-extending sidewall portions 46 of top member 40 include a pair of opposed upper sidewall portions 60 each extending downwardly from one of the opposite edges 52 of central top-wall portion 50 to inner edge 56 of one of lateral top-wall portions 54. Lateral top-wall portions 54 include a side flange 62 at its outer edge 58, and further define tab-receiving apertures 64 which are engageable with tabs 86 of upwardly-extending sidewalls 84 of bottom member 80.

Power-related components 24, 26 and 30, capacitor mounting strap 28, socket 34 and socket mount 32 are all enclosed within, and secured with respect to top member 40 of housing 22. Top member 40 of housing 22 provides a plurality of fastener receptors 39 to receive fasteners in threaded engagement therewith to secure ballast 24, capacitor 26, igniter 30 and socket mount 32 to housing 22. Lamp-mounting socket 34 is secured to socket mount 32 and positioned with its lamp-receiving end substantially aligned vertically and horizontally with socket window 90.

Figure 8:
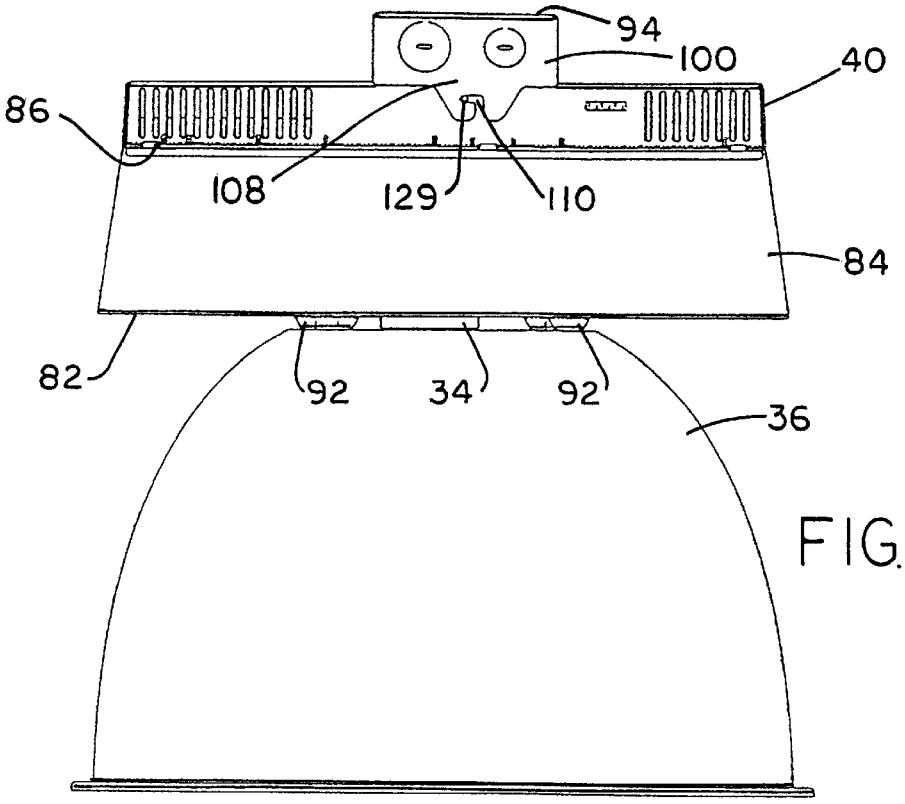
FIG. 8 is a front elevation of the device of FIG. 5.
Figure 9:
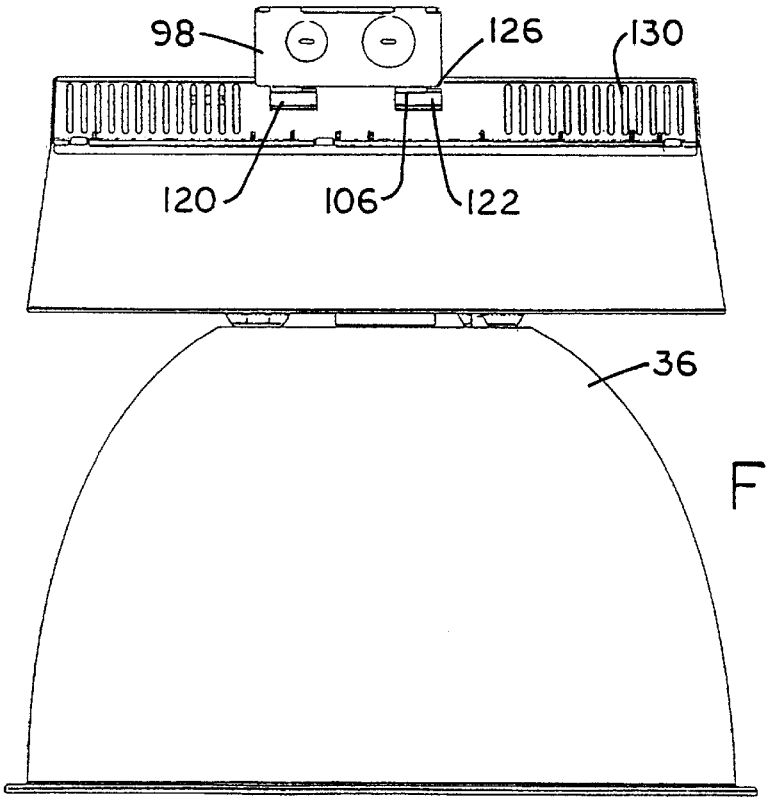
FIG. 9 is a rear elevation of the device of FIG. 5.

Referring to FIGS. 8 and 9, bottom wall 82 of bottom member 80 further includes a plurality of downward projections 92 around socket window 90. Reflector 36 is secured to housing 22 by attachment at downward projections 92 which forms an air-flow gap between bottom wall 82 and reflector 36. Housing 22 further includes a plurality of vents 130 at various locations on top member 40 and bottom member 80, particularly including at locations adjacent to heat-producing components, such as ballast 24.

As seen in FIGS. 3 and 4, central top-wall portion 50 of top member 40 has inner and outer surfaces, 66 and 68, respectively, and a center region 70 defining a pair of adjacent hanger-member apertures 72 therethrough. Central top-wall portion 50 further includes fastener apertures 74 on either side of hanger-member apertures 72.

A hanger member 76, FIGS. 1 and 2, is formed by a series of portions including (a) a base portion 76*a* having a threaded aperture 77 therethrough and secured to the inner surface 66 of central top-wall portion 50 adjacent to a chosen one of the hanger-member apertures 72, (b) a through portion 76*b* extending through the chosen hanger-member aperture 72, (c) an offsetting portion 76*c* extending from through portion 76*b* laterally along the outer surface and (d) an offset portion 76*d* extending from offsetting portion 76*c* and forming an upper support end 78. Hanger member 76 may be mounted with its offset portion 76*d* at whichever one of four positions is closest to the center of gravity of light fixture 20 as determined by the particular choice of power-related components within housing 22. Base portion 76*a* of hanger member 76 is secured to inner surface 66 of top wall 42 with a fastener extending through one of the fastener apertures 74 in top wall 42 and into threadable engagement with threaded aperture 77 of base portion 76*a* of hanger member 76.

Referring now to FIGS. 5–7 and 11, a junction box 94 may be secured to housing 22 in position adjacent to center region 70 of top wall 50. Junction box 94 is generally box-shaped and includes a top surface 96, first and second sidewalls 98 and 100, respectively and opposed endwalls 102. Top surface 96 of junction box 94 defines a second pair of adjacent hanger-member apertures 104 therethrough, the second pair of hanger-member apertures 104 being positioned and arranged to provide at least three positions for mounting hanger member 76.

Figure 10:
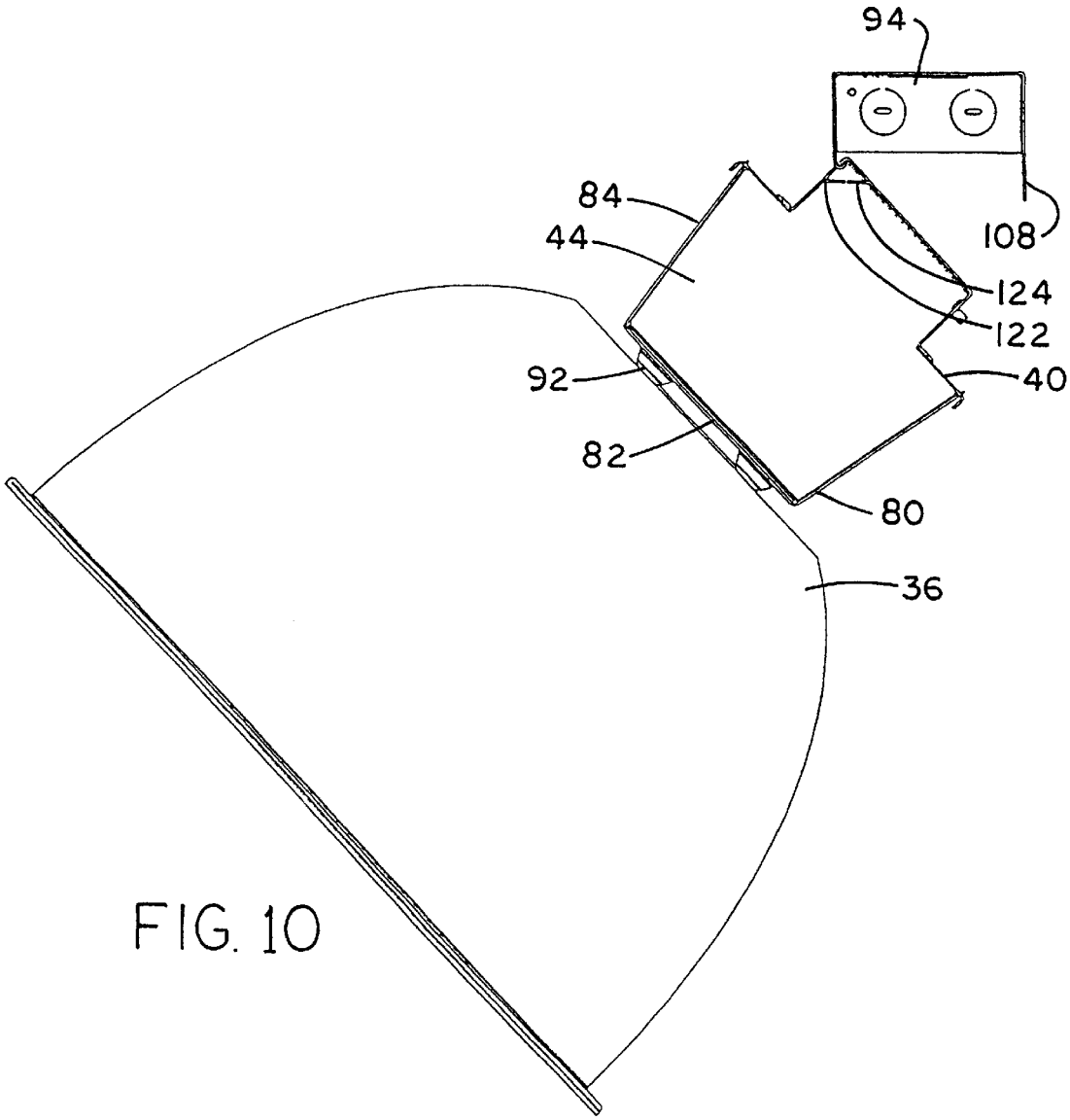
FIG. 10 is a side elevation of the device of FIG. 5 in hanging position during installation or service.
Figure 11:
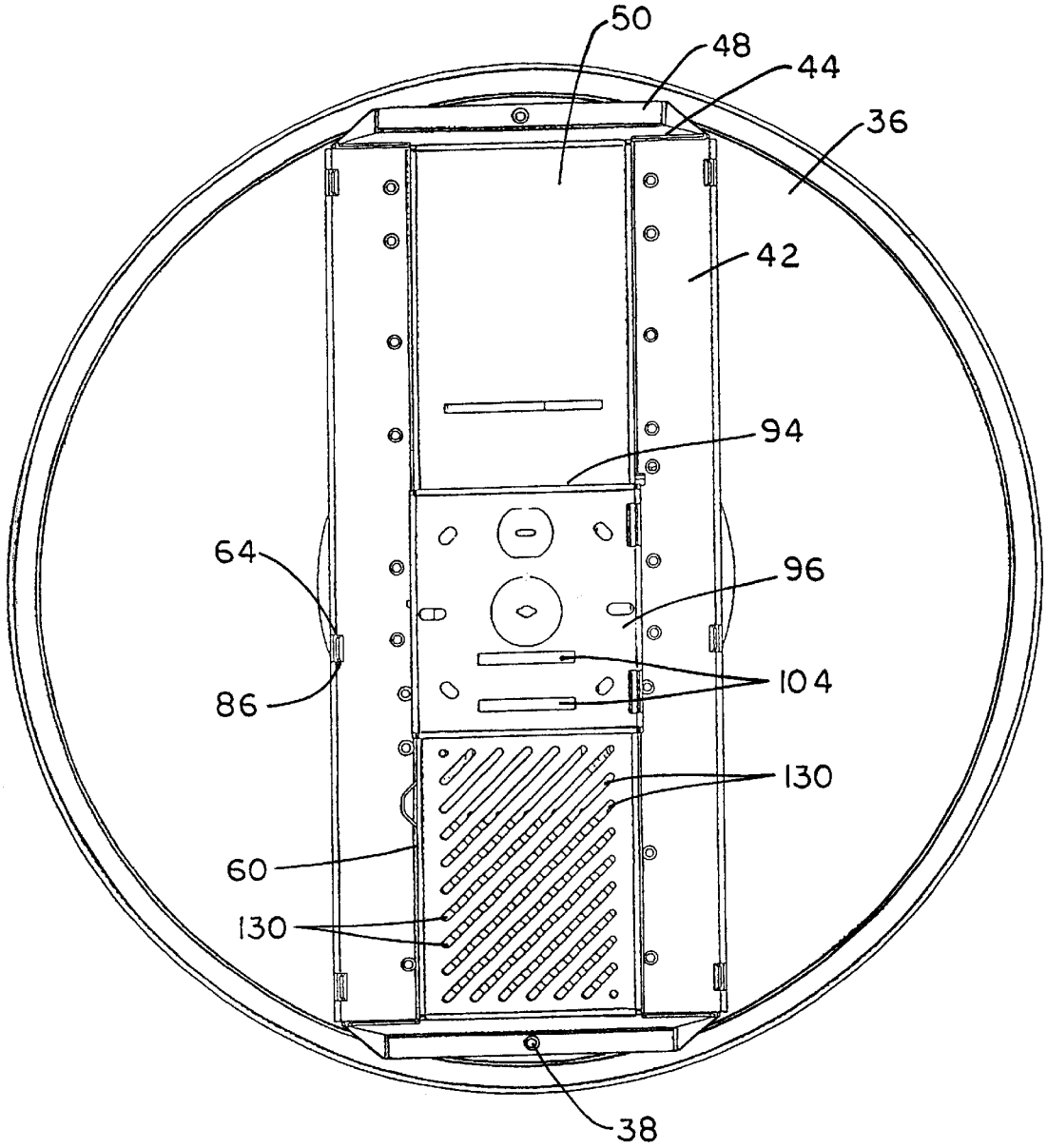
FIG. 11 is a top view of the device of FIG. 5.

Top member 40 of housing 22 further includes a spaced pair of hook-hold openings 120 at the common edge of one upper side-wall portion 60 and center region 70 of top wall 50. As best seen in FIGS. 4 and 10, hook-hold openings 120 are formed by first tongue portions 122 which are bent inwardly from upper side-wall portion 60 adjacent to top wall 50 and terminate upwardly in pivot edges 126. Junction box 94 includes a pair of hooks 106 which project from first sidewall 98 thereof. Hooks 106 each project into one of hook-hold openings 120 and upwardly around pivot edge 126 in top member 40 of housing 22. By such arrangement light fixture 20 can safely hang on junction box hooks 106 during installation or service without being fully secured to junction box 94.

Second tongue portions 124 are bent inwardly from center region 70 of top wall 50 adjacent to upper side-wall portion 60. The orientation of each pair of tongue portions 122 and 124, which are at 45° to the walls from which they are formed, are such that their distal ends are closely adjacent one another. By such arrangement, each pair of tongue portions forms a wire passageway to facilitate organization of internal wires and keep them from being damaged during assembly.

Figure 5:
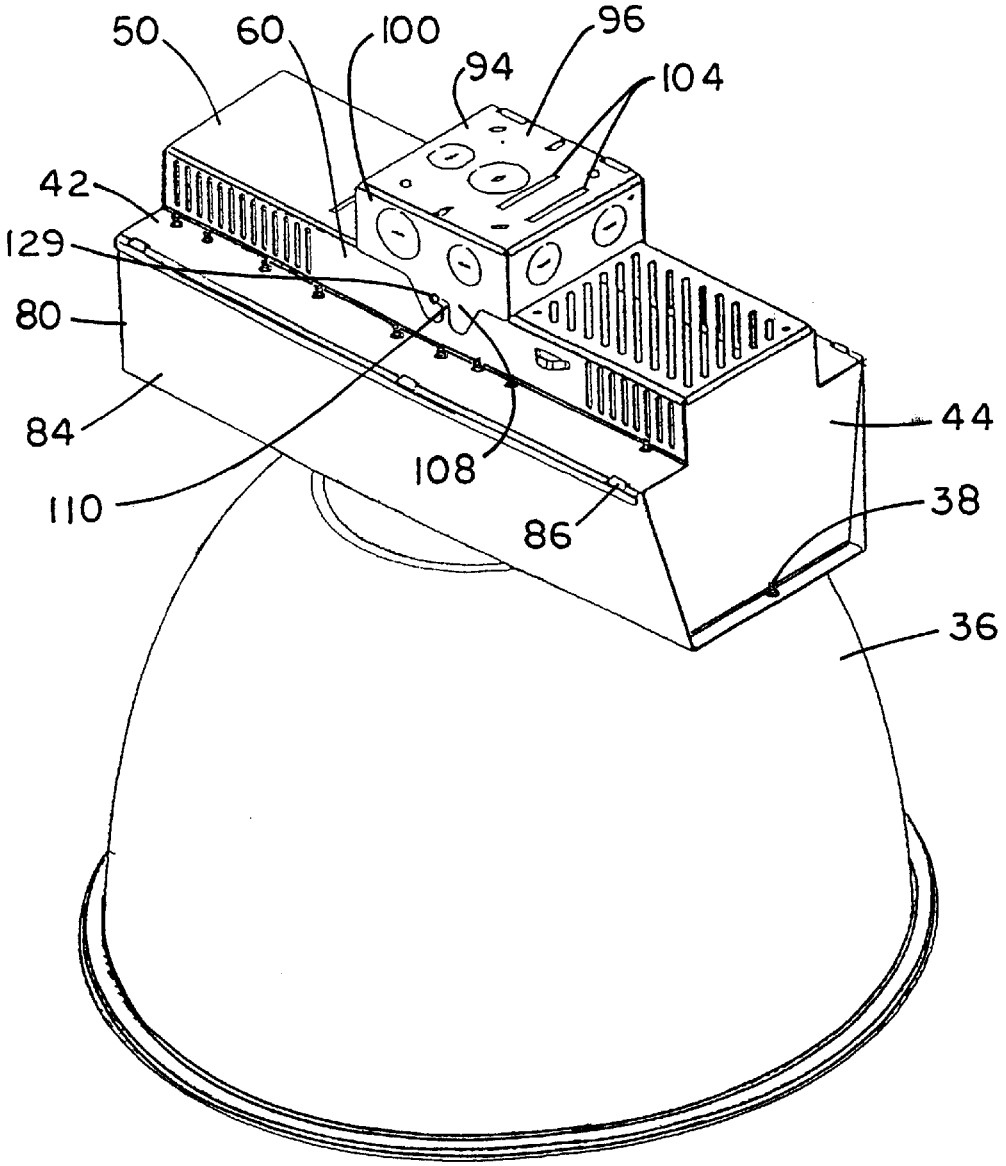
FIG. 5 is a perspective view of another embodiment of the device of FIG. 1.
Figure 6:
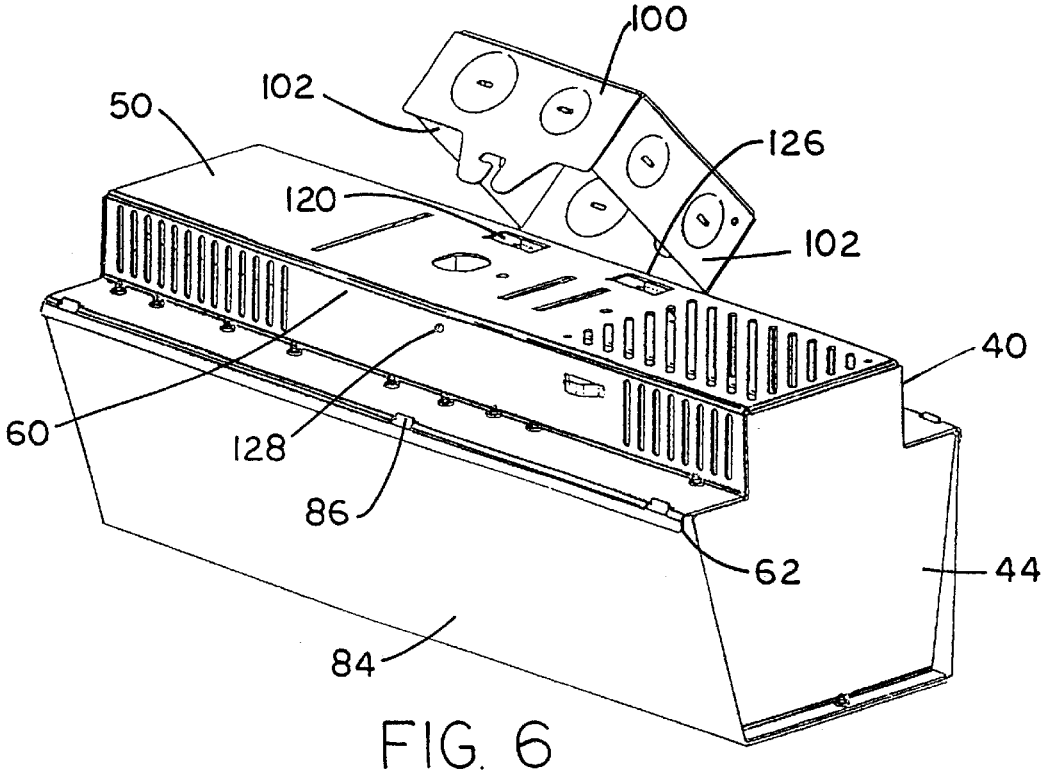
FIG. 6 is a perspective view of the housing and junction box of the device of FIG. 5.
Figure 7:
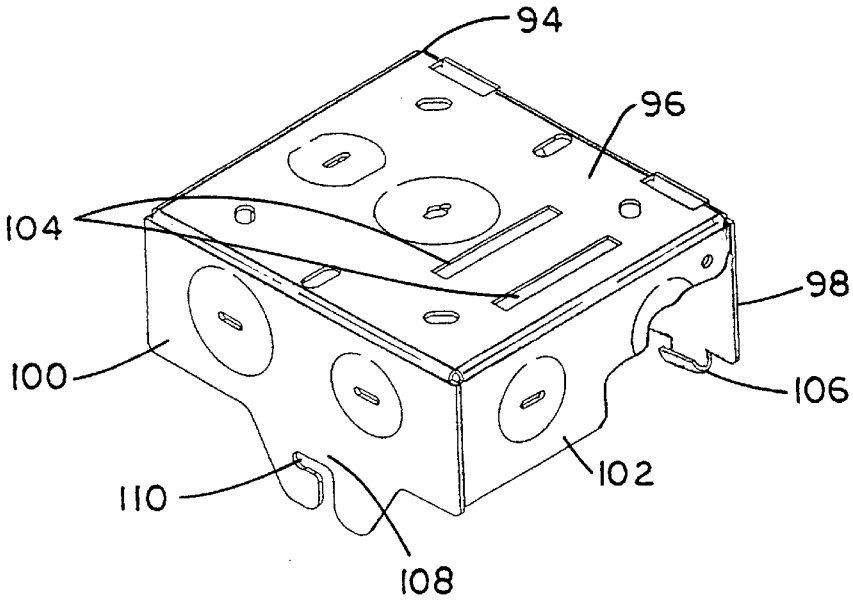
FIG. 7 is a partial cut-away perspective view of the junction box of FIG. 5.

Second edge 100 of junction box 94 includes a tab 108 projecting downwardly forming an inverted J-shaped fastener-engaging slot 110. A fastener-engaging aperture 128 is located opposite hook-hold apertures 120 on upper side-wall portion 60 of top member 40 and receives a fastener 129 in threadable engagement therewith to secure junction box 94 to housing 22, as seen in FIGS. 5–7.

FIG. 12 illustrates the method of manufacture of overhead industrial light fixture 20.

Before assembly, top member 40 and bottom member 80 are formed, preferably by sheet metal stamping and bending operations. Thereafter, assembly involves first placing top member 40 in inverted orientation on a work support structure 132, which may be a table or an assembly-line surface. Then, ballast 24 is placed at its assigned location bridging central top-wall portion 50 and secured to lateral top-wall portions 54 with fasteners (not shown) threadably engaged with aligned fastener-receptors 39. Capacitor 26 is secured to top member 40 between upper sidewall portions 60 by capacitor mounting strap 28 which is attached to lateral top-wall portions 54 at its assigned location, such attachment being by means of fasteners threadably engaged with certain of the fastener-receptors 39 which are aligned therewith. Igniter 30 is secured to lateral top-wall portions 54 by attachment of fasteners to certain aligned fastener-receptors 39. All of such attachment is by engagement of fasteners in a common downward direction with certain of the fastener-receptors 39 in lateral top-wall portions 54.

Socket mount 32 is secured to lateral top-wall portions 54 by attachment of fasteners in the aforementioned common downward direction to certain aligned fastener-receptors 39. Socket mount 32 supports lamp-mounting socket 34 within housing 22.

Assembly continues by placement of bottom member 80, in an inverted orientation, on top member 40. Bottom member 80 is then secured to top member 40 by fasteners 38 which engage fastener-receptor 37. This substantially completes assembly of light fixture 20.

Reflector 36 can be attached to light fixture 20 while preparing for installation at a job site. In some cases, however, reflector 36 may be attached to light fixture 20 immediately upon completion of attachment of bottom member 80 to top member 40. If this is done, reflector 36, in an inverted orientation, is secured to downward projections 92 of bottom wall 82 using fasteners engagable with fastener-receptors 93 formed on downward projections 92, in the aforementioned common direction.

When assembly is completed, light fixture 20 is removed from work support structure 132 and is ready for packaging and shipment.

The sheet metal used in forming top member 40 and bottom member 80 is of a gauge sufficient to provide structural integrity but allow the required bending and stamping operations. Acceptable power-related components and other components used in manufacture of light fixture 20 are known to those skilled in the art. The weights, shapes and sizes of such components, including the reflector, vary greatly, and are fully accommodated by the hanger mounting system described above.

The low profile which is made possible by recessing socket 32 into housing 22 allows the vertical dimension of housing 22 to be as low as 4.5 to 6 inches, even when using electrical components which are standard in overhead industrial light fixtures.

While the principles of this invention have been described in connection with specific embodiments, it should be understood clearly that these descriptions are made only by way of example and are not intended to limit the scope of the invention.

What is claimed is:

1. In an overhead industrial light fixture of the type including a housing, power-related components, and a lamp-mounting socket, the improvement comprising:

the housing having top and bottom walls and sidewalls therebetween together forming a substantially enclosed space, the bottom wall defining a socket location;

the bottom wall including a plurality of downward projections around the socket location; and a reflector secured to the housing by attachment at the downward projections.

2. The overhead industrial light fixture of claim 1 wherein:

the bottom wall defines a socket window at the socket location, the downward projections being around the socket window; and the socket is secured with respect to the housing and positioned substantially within the enclosed space with its lamp-receiving end substantially aligned with the socket window.

3. The overhead industrial light fixture of claim 1 wherein the bottom wall is formed of sheet metal and the projections are stampings therein.

4. The overhead industrial light fixture of claim 1 wherein the housing has enclosure-forming members consisting essentially of:

a top member forming the top wall and downwardly-extending sidewall portions; and a bottom member in fitted engagement with the top member and forming the bottom wall and upwardly-extending sidewall portions which, together with the downwardly-extending sidewall portions, complete the sidewalls.

5. The overhead industrial light fixture of claim 4 wherein the downwardly-extending sidewall portions of the top member include two opposed endwalls each extending downwardly from the top wall and terminating in an end flange engaging and fastened to the bottom member.

6. The overhead industrial light fixture of claim 5 wherein the end flanges of the opposed endwalls engage and are fastened to the bottom wall.

7. The overhead industrial light fixture of claim 4 wherein:

the top member includes (a) a central top-wall portion having opposite edges and (b) a pair of lateral top-wall portions below and on opposite sides of the central top-wall portion, each having an inner and an outer edge; and the downwardly-extending sidewall portions of the top member include a pair of opposed upper sidewall portions each extending downwardly from one of the opposite edges of the central top-wall portion to the inner edge of one of the lateral top-wall portions.

8. The overhead industrial light fixture of claim 7 wherein each of the lateral top-wall portions has a side flange at its outer edge, the side flange and outer edge engaging the upwardly-extending sidewall portions of the bottom member.

9. The overhead industrial light fixture of claim 8 wherein the downwardly-extending sidewall portions of the top member include two opposed endwalls each extending downwardly from the top wall and terminating in an end flange engaging and fastened to the bottom member.

10. The overhead industrial light fixture of claim 9 wherein the end flanges of the opposed endwalls engage and are fastened to the bottom wall.

11. The overhead industrial light fixture of claim 4 wherein:

the top member is formed of sheet metal bent to form the junctures between the top wall and sidewall portions thereof; and the bottom member is formed of sheet metal bent to form the junctures between the bottom wall and sidewall portions thereof.

12. The overhead industrial light fixture of claim 11 wherein the bottom-wall projections are stampings.

* * * * *